US005997584A

United States Patent [19]

Andersen et al.

[11] Patent Number: 5,997,584

[45] Date of Patent: Dec. 7, 1999

[54] METHOD OF TREATING POLYESTER FABRICS

[75] Inventors: Bente Konggaard Andersen, Lyngby; Kim Borch, København K, both of Denmark; Masanobu Abo, Chiba-ken, Japan; Bo Damgaard, Lausanne, Switzerland

[73] Assignee: Novo Nordisk A/S, Bagsvaerd, Denmark

[21] Appl. No.: 09/116,015

[22] Filed: Jul. 15, 1998

Related U.S. Application Data

[60] Provisional application No. 60/054,038, Jul. 28, 1997.

[30] Foreign Application Priority Data

Jul. 4, 1997 [DK] Denmark ..... 0807/97

[51] Int. Cl.[6] ..... D06M 16/00; D06M 101/32

[52] U.S. Cl. ..... 8/137; 8/137.5; 8/401; 435/263; 435/264; 510/300

[58] Field of Search ..... 435/263, 264, 435/135; 8/401, 137, 137.5; 510/300

[56] References Cited

U.S. PATENT DOCUMENTS

| | | |
|---|---|---|
| 4,435,307 | 3/1984 | Barbesgaard et al. . |
| 4,810,414 | 3/1989 | Huge-Jensen et al. . |
| 5,707,858 | 1/1998 | Screws et al. . |

FOREIGN PATENT DOCUMENTS

| | | |
|---|---|---|
| WO 96/17994 | 6/1996 | WIPO . |
| WO 96/34092 | 10/1996 | WIPO . |
| WO 97/27237 | 7/1997 | WIPO . |

*Primary Examiner*—Margaret Einsmann
*Attorney, Agent, or Firm*—Steve T. Zelson, Esq.; Reza Green, Esq.

[57] ABSTRACT

This invention relates to a method of reducing the pilling propensity or colour clarity of polyester fabrics and/or garments, which method comprises treating the fabric with a polyester hydrolytic enzyme and a detergent.

10 Claims, No Drawings

METHOD OF TREATING POLYESTER FABRICS

CROSS-REFERENCE TO RELATED APPLICATIONS

This application is a continuation of PCT/DK98/00306 filed Jul. 3, 1998 and claims priority under 35 U.S.C. 119 of Danish application 0807/97 filed Jul. 4, 1997, and of U.S. provisional application No. 60/054,038 filed Jul. 28, 1997, the contents of which are fully incorporated herein by reference.

TECHNICAL FIELD

This invention relates to a method of reducing the pilling propensity and/or improve the colour clarity of polyester fabrics and/or garments, which method comprises treating the fabric with a polyester hydrolytic enzyme.

BACKGROUND ART

Poly(ethylene terephthalate) fibers accounts for the main part of the polyester applied by the textile industry. The fibers are produced by e.g. poly-condensation of terephthalic acid and ethylene glycol, and drawing of fibers from a melt.

Because of its strength, polyester fabrics and/or garments are subject to pill formation, and possibly the most important of the cloth-finishing processes applied to polyester staple-fibre materials are those designed for control of pilling. All staple-fibre materials tend to form small balls or "pills" of entangled fibres at the cloth surface, when subjected to mild abrasion during wash and wear. If the fabric contains a substantial proportion of fibres having high resistance to flexural abrasion, the pills may be retained on the surface of the cloth in sufficient numbers to produce an unpleasant handle and appearance.

There is no simple solution to the problem of pilling. In the textile industry, polyester fibers are produced as medium- and high-tenacity filament yarns and as staple fibers of various lengths and fiber color to suit the kind of spinning machinery found in the textile trade. Staple fibers are usually drawn to give medium tenacities, but may be spun from polymers of lower average molecular weight to give improved "pilling" performance at the expense of some loss in abrasion resistance. Also, the finisher may reduce the pilling propensity of a fabric by the removal of protruding hairs from the surface of the cloth and by heat treatment to reduce the tendency of the fibres to migrate within the yarns.

These are all solutions to the problem of pilling applied by the textile industry. Solutions to this problem that can be applied by the end user of polyester fabrics have never been suggested, and the consumer still find pilling to be a problem that is encountered when wearing polyester fabrics and garments.

SUMMARY OF THE INVENTION

It has now surprisingly been found that certain polyester hydrolytic enzymes are capable of reducing the pilling propensity of polyester fabrics and garments. In particular it has been found that a group of ethyleneglycol dibenzyl ester (BEB) and/or terephtalic acid diethyl ester (ETE) hydrolytic enzymes are capable of reducing pilling propensity of polyester fabrics and garments. Furthermore, it has been found that the treatment with ethyleneglycol dibenzyl ester (BEB) and/or terephtalic acid diethyl ester (ETE) hydrolytic enzymes is capable of colour clarification of polyester fabrics and/or garments.

Accordingly, in its first aspect, the invention provides a method of reducing the pilling propensity of polyester fabrics and/or garments, which method comprises treating the fabric or garment with a terephtalic acid diethyl ester hydrolytic enzyme and/or an ethyleneglycol dibenzyl ester hydrolytic enzyme, and which method is carried out in presence of a detergent.

In another aspect, the invention relates to the use of a terephtalic acid diethyl ester hydrolytic enzyme and/or an ethyleneglycol dibenzyl ester hydrolytic enzyme in a method for reducing the pilling propensity of polyester fabrics and/or garments.

In a further aspect, the invention provides a method of colour clarification of polyester fabrics and/or garments, which method comprises treating the fabric or garment with a terephtalic acid diethyl ester hydrolytic enzyme and/or an ethyleneglycol dibenzyl ester hydrolytic enzyme, and which method is carried out in presence of a detergent.

In yet another aspect, the invention relates to the use of a terephtalic acid diethyl ester hydrolytic enzyme and/or an ethyleneglycol dibenzyl ester hydrolytic enzyme in a method of colour clarification of polyester fabrics and/or garments.

DETAILED DISCLOSURE OF THE INVENTION

The invention provides a method of reducing the pilling propensity of polyester fabrics and/or garments. The invention furthermore provides a method of improving the colour clarity of polyester fabrics and/or garments.

Polyester Fabrics or Garments

The polyester fabrics and/or garments treated according to the method of the invention may be any fabric or fabric blend comprising polyester. Actually, the pilling propensity is most pronounced in fabrics and/or garments comprising polyester fibers in blends with fibers of a different material.

In a preferred embodiment the fabric is a fabric blend comprising more than 50% (w/w) of polyester, in particular more than 75% (w/w) of polyester, more than 90% (w/w) of polyester, or more than 95% (w/w) of polyester. In a most preferred embodiment, the process of the invention is applied to fabrics or garments consisting essentially of poly(ethylene terephthalate) polyester material, i.e. pure poly(ethylene terephthalate) polyester material.

Polyester Hydrolytic Enzymes

The method of the invention comprises treating the fabric or garment with a polyester hydrolytic enzyme. It has surprisingly been found that a certain group of enzymes are capable of hydrolysing terephtalic acid diethyl ester (ETE) and/or an ethyleneglycol dibenzyl ester (BEB), and therefore are polyesterhydrolytic enzymes.

Determination of which enzymes are ETE and/or BEB hydrolytic enzyme may be carried out as described in Example 1, below.

The method of the invention comprises treating the fabric or garment with a ETE hydrolytic enzyme and/or a BEB hydrolytic enzyme and a detergent. In a preferred embodiment, the method of the invention comprises treating the fabric or garment with a ETE hydrolytic enzyme. In another preferred embodiment, the method of the invention comprises treating the fabric or garment with a BEB hydrolytic enzyme. The BEB hydrolytic enzyme may in particular be a $BEB^{10}$ hydrolytic enzyme or $BEB^{30}$ hydrolytic enzyme, as defined in Example 1, below. Preferably the ETE hydrolytic enzyme has a hydrolytic activity of at least 50%, more preferably of at least 90% and most preferably of at least 95%. Preferably the $BEB^{10}$ or $BEB^{30}$ hydrolytic enzyme has a hydrolytic activity of at least 50%, more preferably at least 90% and most preferably at least 95%. In a most preferred embodiment both the $BEB^{10}$ , $BEB^{30}$ and ETE hydrolytic activity are at least 50%, more preferably at least 90% and most preferably at least 95%.

ETE hydrolytic enzyme and/or a BEB hydrolytic enzyme may be obtained from any convenient source. Preferably the ETE hydrolytic enzyme and/or BEB hydrolytic enzyme is obtained from a microbial source. In a more preferred embodiment, the ETE hydrolytic enzyme and/or BEB hydrolytic enzyme is obtained from a strain of *Candida,* in particular *Candida antarctica* and *Candida cylindracea* (syn. *Candida rugosa*), a strain of *Humicola,* in particular *Humicola insolens,* a strain of *Pseudomonas,* in particular *Pseudomonas cepacia.*

The treatment

The present invention provides a method of reducing the pilling propensity of polyester fabrics and/or garments. Furthermore, the present invention provides a method of improving the colour clarification of polyester fabrics and/or garments.

Enzyme dosage must be a function of the enzyme(s) applied and the reaction time and conditions given. It is at present contemplated that the enzyme(s) may be dosed in a total amount of from about 0.05 micro gram per gram fabrics and/or garments to about 5000 microgram per gram fabrics and/or garments.

The enzymatic treatment may be carried out in the temperature range of from about 30° C. to about 100° C., preferentially from about 40° C. to about 90° C. The pH range may, dependent on the enzyme(s) applied, be from about pH 5 to pH 11 preferably from about pH 7 to pH 11. It is at present contemplated that a suitable reaction time may be in the range of from about 15 minutes to about 3 hours. The detergent may be used in an amount of from about 0.001 g/l wash liquor to about 10 g/l wash liquor.

The treatment is preferably carried out simultaneously with a conventional laundry process, and is carried out in presence of a detergent. In a more preferred embodiment, the method of the invention is carried out in the presence of a detergent enzyme, in particular a proteolytic enzyme, a lipolytic enzyme, a cellulytic enzyme, a amylolytic enzyme, an oxidase enzyme, a peroxidase enzyme, and a pectinase enzyme, or mixtures hereof. In a particularly preferred embodiment, the method of the invention is carried out in presence of a detergent and a cellulytic enzyme. The method is preferably carried out by incorporating the above terephtalic acid diethyl ester hydrolytic enzyme and/or ethyleneglycol dibenzyl ester hydrolytic enzyme in a laundry detergent composition.

Detergent

In the context of this invention, a detergent is synonymous with a surfactant, and it may in particular be a nonionic surfactant, an anionic surfactant, a cationic surfactant, an ampholytic surfactant, a zwitterionic surfactant, and a semipolar surfactant, or a mixture hereof.

The surfactant is typically present in a detergent composition at a level from 0.1% to 60% by weight.

The surfactant is preferably formulated to be compatible with enzyme components present in the composition. In liquid or gel compositions the surfactant is most preferably formulated in such a way that it promotes, or at least does not degrade, the stability of any enzyme in these compositions.

Preferred systems to be used according to the present invention comprise as a surfactant one or more of the nonionic and/or anionic surfactants described herein.

Polyethylene, polypropylene, and polybutylene oxide condensates of alkyl phenols are suitable for use as the nonionic surfactant of the surfactant systems of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with about 1 to about 25 moles of ethylene oxide are suitable for use as the nonionic surfactant of the nonionic surfactant systems of the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 2 to about 10 moles of ethylene oxide per mole of alcohol. About 2 to about 7 moles of ethylene oxide and most preferably from 2 to 5 moles of ethylene oxide per mole of alcohol are present in said condensation products. Examples of commercially available nonionic surfactants of this type include Tergitol™ 15-S-9 (The condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodolm 23-3 (the condensation product of $C_{12}$–$C_{13}$ linear alcohol with 3.0 moles of ethylene oxide), Neodol™ 45-7 (the condensation product of $C_{14}$–$C_{15}$ linear alcohol with 7 moles of ethylene oxide), Neodol™ 45-5 (the condensation product of $C_{14}$–$C_{15}$ linear alcohol with 5 moles of ethylene oxide) marketed by Shell Chemical Company, Kyro™ EOB (the condensation product of $C_{13}$–$C_{15}$ alcohol with 9 moles ethylene oxide), marketed by The Procter & Gamble Company, and Genapol LA 050 (the condensation product of $C_{12}$–$C_{14}$ alcohol with 5 moles of ethylene oxide) marketed by Hoechst. Preferred range of HLB in these products is from 8–11 and most preferred from 8–10.

Also useful as the nonionic surfactant of the surfactant systems of the present invention are alkylpolysaccharides disclosed in U.S. Pat. No. 4,565,647, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4-, and/or 6-position, preferably predominantly the 2-position.

The condensation products of ethylene oxide with a hydrophobic base formed by the condensation of propylene oxide with propylene glycol are also suitable for use as the additional nonionic surfactant systems of the present invention. The hydrophobic portion of these compounds will preferably have a molecular weight from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Preferred for use as the nonionic surfactant of the surfactant systems of the present invention are polyethylene oxide condensates of alkyl phenols, condensation products of primary and secondary aliphatic alcohols with from about 1 to about 25 moles of ethyleneoxide, alkylpolysaccharides, and mixtures hereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Highly preferred nonionic surfactants are polyhydroxy fatty acid amide surfactants of the formula

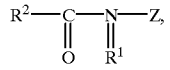

wherein $R^1$ is H, or $R^1$ is $C_{1-4}$ hydrocarbyl, 2-hydroxyethyl, 2-hydroxypropyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is straight $C_{11-15}$ alkyl or $C_{16-18}$ alkyl or alkenyl chain such as coconut alkyl or mixtures thereof, and Z is derived from a reducing sugar such as glucose, fructose, maltose or lactose, in a reductive amination reaction.

Highly preferred anionic surfactants include alkyl alkoxylated sulfate surfactants. Examples hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}E(1.0)M$), $C_{12-C18}$ alkyl polyethoxylate (2.25) sulfate ($C_{12}$–$C_{18}(2.25)M$, and $C_{12}$–$C_{18}$ alkyl polyethoxylate (3.0) sulfate ($C_{12}$–$C_{18}E(3.0)M$), and $C_{12}$–$C_{18}$ alkyl polyethoxylate (4.0) sulfate ($C_{12}$–$C_{18}E(4.0)M$), wherein M is conveniently selected from sodium and potassium. Suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

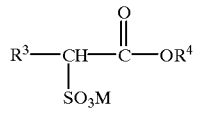

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethonolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16}$–$C_{18}$ alkyl chains are preferred for higher wash temperatures (e.g. above about 50° C.).

Other anionic surfactants useful for detersive purposes can also be included in the laundry detergent compositions of the present invention. Theses can include salts (including, for example, sodium, potassium, ammonium, and substituted ammonium salts such as mono- di- and triethanolamine salts) of soap, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$—M+ wherein R is a $C_8$14 $C_{22}$ alkyl, k is an integer from 1 to 10, and M is a soluble salt forming cation. Resin acids and hydrogenated resin acids are also suitable, such as rosin, hydrogenated rosin, and resin acids and hydrogenated resin acids present in or derived from tall oil.

Alkylbenzene sulfonates are highly preferred. Especially preferred are linear (straight-chain) alkyl benzene sulfonates (LAS) wherein the alkyl group preferably contains from 10 to 18 carbon atoms.

Further examples are described in "Surface Active Agents and Detergents" (Vol. I and II by Schwartz, Perry and Berch). A variety of such surfactants are also generally disclosed in U.S. Pat. No. 3,929,678, (Column 23, line 58 through Column 29, line 23, herein incorporated by reference).

When included therein, the laundry detergent compositions of the present invention typically comprise from about 1% to about 40%, preferably from about 3% to about 20% by weight of such anionic surfactants.

The laundry detergent compositions of the present invention may also contain cationic, ampholytic, zwitterionic, and semi-polar surfactants, as well as the nonionic and/or anionic surfactants other than those already described herein.

Cationic detersive surfactants suitable for use in the laundry detergent compositions of the present invention are those having one long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)_y]_2R^5N+X-$$

wherein $R^2$ is an alkyl or alkyl benzyl group having from about 8 to about 18 carbon atoms in the alkyl chain, each $R^3$ is selected form the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOHCHOHCOR^6CHOHCH_2OH$, wherein $R^6$ is any hexose or hexose polymer having a molecular weight less than about 1000, and hydrogen when y is not 0; $R^5$ is the same as $R^4$ or is an alkyl chain, wherein the total number of carbon atoms or $R^2$ plus $R^5$ is not more than about 18; each y is from 0 to about 10, and the sum of the y values is from 0 to about 15; and X is any compatible anion.

Highly preferred cationic surfactants are the water soluble quaternary ammonium compounds useful in the present composition having the formula:

$$R_1R_2R_3R_4N^+X^- \quad \text{(i)}$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$–$C_{15}$, particularly where the alkyl group is a mixture of chain lengths derived from coconut or palm kernel fat or is derived synthetically by olefin build up or OXO alcohols synthesis.

Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12-15}$ dimethyl hydroxyethyl ammonium chloride or bromide;

coconut dimethyl hydroxyethyl ammonium chloride or bromide;

myristyl trimethyl ammonium methyl sulphate;

lauryl dimethyl benzyl ammonium chloride or bromide;

lauryl dimethyl $(ethenoxy)_4$ ammonium chloride or bromide;

choline esters (compounds of formula (i) wherein $R_1$ is

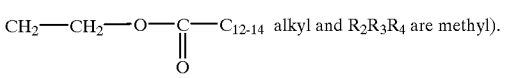

di-alkyl imidazolines [compounds of formula (i)].

Other cationic surfactants useful herein are also described in U.S. Pat. No. 4,228,044 and in EP 000 224.

When included therein, the laundry detergent compositions of the present invention typically comprise from 0.2% to about 25%, preferably from about 1% to about 8% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 (column 19, lines 18–35) for examples of ampholytic surfactants.

When included therein, the laundry detergent compositions of the present invention typically comprise from 0.2% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 (column 19, line 38 through column 22, line 48) for examples of zwitterionic surfactants.

When included therein, the laundry detergent compositions of the present invention typically comprise from 0.2% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula:

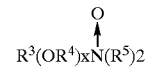

$$R^3(OR^4)xN(R^5)2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3: and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the laundry detergent compositions of the present invention typically comprise from 0.2% to about 15%, preferably from about 1% to about 10% by weight of such semi-polar nonionic surfactants.

Builder system

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B, HS or MAP.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenle-enschrift 2,446,686, and 2,446,487, U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2,-ethane tetracarboxylates, 1,1,3,3-propane tetracarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis-cis-tetracarboxylates, cyclopentadienide pentacarboxylates, 2,3,4,5-tetrahydro-furan - cis, cis, cis-tetracarboxylates, 2,5-tetrahydro-furan-cis, discarboxylates, 2,2,5,5,-tetrahydrofuran—tetracarboxylates, 1,2,3,4,5,6-hexane—hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (SKS-6), and a water-soluble carboxylate chelating agent such as citric acid.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and $Na_4$EDDS. Examples of such preferred magnesium salts of EDDS include MgEDDS and $Mg_2$EDDS. The magnesium salts are the most preferred for inclusion in compositions in accordance with the invention.

Preferred builder systems include a mixture of a water-insoluble aluminosilicate builder such as zeolite A, and a water soluble carboxylate chelating agent such as citric acid.

Other builder materials that can form part of the builder system for use in granular compositions include inorganic materials such as alkali metal carbonates, bicarbonates, silicates, and organic materials such as the organic phosphonates, amino polyalkylene phosphonates and amino polycarboxylates.

Other suitable water-soluble organic salts are the homo- or co-polymeric acids or their salts, in which the polycarboxylic acid comprises at least two carboxyl radicals separated form each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 5% to 80% by weight of the composition. Preferred levels of builder for liquid detergents are from 5% to 30%.

Other Enzymes

Preferred detergent compositions, in addition to the enzyme preparation of the invention, comprise other enzyme (s) which provides cleaning performance and/or fabric care benefits.

Such enzymes include other proteases, lipases, cutinases, amylases, cellulases, peroxidases, oxidases (e.g. laccases).

Proteases: Any protease suitable for use in alkaline solutions can be used. Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of alkaline proteases are subtilisins, especially those derived from *Bacillus,* e.g., subtilisin Novo, subtilisin Carlsberg, subtilisin 309, subtilisin 147 and subtilisin 168 (described in WO 89/06279). Examples of trypsin-like proteases are trypsin (e.g. of porcine or bovine origin) and the *Fusarium* protease described in WO 89/06270.

Preferred commercially available protease enzymes include those sold under the trade names Alcalase, Savinase, Primase, Durazym, and Esperase by Novo Nordisk A/S (Denmark), those sold under the tradename Maxatase, Maxacal, Maxapem, Properase, Purafect and Purafect OXP by Genencor International, and those sold under the tradename Opticlean and Optimase by Solvay Enzymes. Protease enzymes may be incorporated into the compositions in accordance with the invention at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

Lipases: Any lipase suitable for use in alkaline solutions can be used. Suitable lipases include those of bacterial or fungal origin. Chemically or genetically modified mutants are included.

Examples of useful lipases include a *Humicola lanuginosa* lipase, e.g., as described in EP 258 068 and EP 305 216, a *Rhizomucor miehei* lipase, e.g., as described in EP 238 023, a *Candida* lipase, such as a *C. antarctica* lipase, e.g., the *C. antarctica* lipase A or B described in EP 214 761, a *Pseudomonas lipase* such as a *P. alcaligenes* and *P. pseudoalcaligenes* lipase, e.g., as described in EP 218 272, a *P. cepacia* lipase, e.g., as described in EP 331 376, a *P. stutzeri* lipase, e.g., as disclosed in GB 1,372,034, a *P. fluorescens* lipase, a *Bacillus lipase,* e.g., a *B. subtilis* lipase (Dartois et al., (1993), Biochemica et Biophysica acta 1131, 253–260), a *B. stearo-thermophilus* lipase (JP 64/744992) and a *B. pumilus* lipase (WO 91/16422).

Furthermore, a number of cloned lipases may be useful, including the *Penicillium camembertii* lipase described by Yamaguchi et al., (1991), *Gene* 103, 61–67), the *Geotricum candidum* lipase (Schimada, Y. et al., (1989), *J. Biochem.,* 106, 383–388), and various *Rhizopus* lipases such as a *R. delemar* lipase (Hass, M. J. et al., (1991), *Gene* 109, 117–113), a *R. niveus* lipase (Kugimiya et al., (1992), *Biosci. Biotech. Biochem.* 56, 716–719) and a *R. oryzae* lipase.

Especially suitable lipases are lipases such as M1 Lipase™, Luma fast™ and Lipomax™ (Genencor), Lipolase™ and Lipolase Ultra™ (Novo Nordisk A/S), and Lipase P "Amano" (Amano Pharmaceutical Co. Ltd.).

The lipases are normally incorporated in the detergent composition at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

Amylases: Any amylase (α and/or β) suitable for use in alkaline solutions can be used. Suitable amylases include those of bacterial or fungal origin. Chemically or genetically modified mutants are included. Amylases include, for example, α-amylases obtained from a special strain of *B. licheniformis,* described in more detail in GB 1,296,839. Commercially available amylases are Duramyl™, Termamyl™, Fungamyl™ and BAN™ (available from Novo Nordisk A/S) and Rapidase™ and Maxamyl P™ (available from Genencor).

The amylases are normally incorporated in the detergent composition at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

Cellulases: In the present context, the term "cellulase or "cellulolytic enzyme" refers to an enzyme which catalyses the degradation of cellulose to glucose, cellobiose, triose and other cellooligosaccharides. Cellulose is a polymer of glucose linked by beta-1,4-glucosidic bonds. Cellulose chains form numerous intra- and intermolecular hydrogen bonds, which result in the formation of insoluble cellulose microfibrils. Microbial hydrolysis of cellulose to glucose involves the following three major classes of cellulases: endo-1,4-beta-glucanases (EC 3.2.1.4), which cleave beta-1,4-glucosidic links randomly throughout cellulose molecules; cellobiohydrolases (EC 3.2.1.91)(exoglucanases), which digest cellulose from the nonreducing end; and beta-glucosidases (EC 3.2.1.21), which hydrolyse cellobiose and low-molecular-mass cellodextrins to release glucose. Most cellulases consist of a cellulose-binding domain (CBD) and a catalytic domain (CAD) separated by a linker rich in proline and hydroxy amino acid residues. In the specification and claims, the term "endoglucanase" is intended to denote enzymes with cellulolytic activity, especially endo-1,4-beta-glucanase activity, which are classified in EC 3.2.1.4 according to the Enzyme Nomenclature (1992) and are capable of catalysing (endo)hydrolysis of 1,4-beta-D-glucosidic linkages in cellulose, lichenin and cereal beta-D-glucans including 1,4-linkages in beta-D-glucans also containing 1,3-linkages. Any cellulase suitable for use in alkaline solutions can be used. Suitable cellulases include those of bacterial or fungal origin. Chemically or genetically modified mutants are included. Suitable cellulases are disclosed in U.S. Pat. No. 4,435,307, which discloses fungal cellulases produced from *Humicola insolens*. Especially suitable cellulases are the cellulases having colour care benefits. Examples of such cellulases are cellulases described in European patent application No. 0 495 257, WO 91/17243 and WO 96/29397.

Commercially available cellulases include Celluzyme™ and Denimax™ produced by a strain of *Humicola insolens,* (Novo Nordisk A/S), and KAC-500(B)™ (Kao Corporation).

Cellulases are normally incorporated in the detergent composition at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

Peroxidases/Oxidases: Peroxidase enzymes are used in combination with hydrogen peroxide or a source thereof (e.g. a percarbonate, perborate or persulfate). Oxidase enzymes are used in combination with oxygen. Both types of enzymes are used for "solution bleaching", i.e. to prevent transfer of a textile dye from a dyed fabric to another fabric when said fabrics are washed together in a wash liquor, preferably together with an enhancing agent as described in e.g. WO 94/12621 and WO 30 95/01426. Suitable peroxidases/oxidases include those of plant, bacterial or fungal origin. Chemically or genetically modified mutants are included.

Peroxidase and/or oxidase enzymes are normally incorporated in the detergent composition at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

Mixtures of the above mentioned enzymes are encompassed herein, in particular a mixture of a protease, an amylase, a lipase and/or a cellulase.

The enzyme of the invention, or any other enzyme incorporated in the detergent composition, is normally incorporated in the detergent composition at a level from 0.00001% to 2% of enzyme protein by weight of the composition, preferably at a level from 0.0001% to 1% of enzyme protein by weight of the composition, more preferably at a level from 0.001% to 0.5% of enzyme protein by weight of the composition, even more preferably at a level from 0.01% to 0.2% of enzyme protein by weight of the composition.

Bleaching agents: Additional optional detergent ingredients that can be included in the detergent compositions of the present invention include bleaching agents such as PB1, PB4 and percarbonate with a particle size of 400–800 microns. These bleaching agent components can include one or more oxygen bleaching agents and, depending upon the bleaching agent chosen, one or more bleach activators. When present oxygen bleaching compounds will typically be present at levels of from about 1% to about 25%. In general, bleaching compounds are optional added components in non-liquid formulations, e.g. granular detergents.

The bleaching agent component for use herein can be any of the bleaching agents useful for detergent compositions including oxygen bleaches as well as others known in the art.

The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, U.S. Pat. No. 740,446, EP 0 133 354 and U.S. Pat. No. 4,412,934. Highly preferred bleaching agents also include 6-nonylamino-6-oxoperoxycaproic acid as described in U.S. Pat. No. 4,634,551.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5–10% by weight of the finished product, preferably 1–5% by weight.

The hydrogen peroxide releasing agents can be used in combination with bleach activators such as tetraacetylethylenediamine (TAED), nonanoyloxybenzenesulfonate (NOBS, described in U.S. Pat. No. 4,412,934), 3,5-trimethyl-hexsanoloxybenzenesulfonate (ISONOBS, described in EP 120 591) or pentaacetylglucose (PAG), which are perhydrolyzed to form a peracid as the active bleaching species, leading to improved bleaching effect. In addition, very suitable are the bleach activators C8(6-octanamido-caproyl) oxybenzene-sulfonate, C9(6-nonanamido caproyl) oxybenzenesulfonate and C10 (6-decanamido caproyl) oxybenzenesulfonate or mixtures thereof. Also suitable activators are acylated citrate esters such as disclosed in European Patent Application No. 91870207.7.

Useful bleaching agents, including peroxyacids and bleaching systems comprising bleach activators and peroxygen bleaching compounds for use in cleaning compositions according to the invention are described in application U.S. application Ser. No. 08/136,626.

The hydrogen peroxide may also be present by adding an enzymatic system (i.e. an enzyme and a substrate therefore) which is capable of generation of hydrogen peroxide at the beginning or during the washing and/or rinsing process. Such enzymatic systems are disclosed in European Patent Application EP 0 537 381.

Bleaching agents other than oxygen bleaching agents are also known in the art and can be utilized herein. One type of non-oxygen bleaching agent of particular interest includes photoactivated bleaching agents such as the sulfonated zinc and-/or aluminium phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent composition will contain about 0.025% to about 1.25%, by weight, of sulfonated zinc phthalocyanine.

Bleaching agents may also comprise a manganese catalyst. The manganese catalyst may, e.g., be one of the compounds described in "Efficient manganese catalysts for low-temperature bleaching", *Nature* 369, 1994, pp. 637–639.

Suds suppressors: Another optional ingredient is a suds suppressor, exemplified by silicones, and silica-silicone mixtures. Silicones can generally be represented by alkylated polysiloxane materials, while silica is normally used in finely divided forms exemplified by silica aerogels and xerogels and hydrophobic silicas of various types. Theses materials can be incorporated as particulates, in which the suds suppressor is advantageously releasably incorporated in a water-soluble or waterdispersible, substantially non surface-active detergent impermeable carrier. Alternatively the suds suppressor can be dissolved or dispersed in a liquid carrier and applied by spraying on to one or more of the other components.

A preferred silicone suds controlling agent is disclosed in U.S. Pat. No. 3,933,672. Other particularly useful suds suppressors are the self-emulsifying silicone suds suppressors, described in German Patent Application DTOS 2,646,126. An example of such a compound is DC-544, commercially available form Dow Corning, which is a siloxane-glycol copolymer. Especially preferred suds controlling agent are the suds suppressor system comprising a mixture of silicone oils and 2-alkyl-alkanols. Suitable 2-alkyl-alkanols are 2-butyl-octanol which are commercially available under the trade name Isofol 12 R.

Such suds suppressor system are described in European Patent Application EP 0 593 841.

Especially preferred silicone suds controlling agents are described in European Patent Application No. 92201649.8. Said compositions can comprise a silicone/ silica mixture in combination with fumed nonporous silica such as Aerosil$^R$.

The suds suppressors described above are normally employed at levels of from 0.001% to 2% by weight of the composition, preferably from 0.01% to 1% by weight.

Other components: Other components used in detergent compositions may be employed such as soil-suspending agents, soil-releasing agents, optical brighteners, abrasives, bactericides, tarnish inhibitors, coloring agents, and/or encapsulated or nonencapsulated perfumes.

Especially suitable encapsulating materials are water soluble capsules which consist of a matrix of polysaccharide and polyhydroxy compounds such as described in GB 1,464,616.

Other suitable water soluble encapsulating materials comprise dextrins derived from ungelatinized starch acid esters of substituted dicarboxylic acids such as described in U.S. Pat. No. 3,455,838. These acid-ester dextrins are, preferably, prepared from such starches as waxy maize, waxy sorghum, sago, tapioca and potato. Suitable examples of said encapsulation materials include N-Lok manufactured by National Starch. The N-Lok encapsulating material consists of a modified maize starch and glucose. The starch is modified by adding monofunctional substituted groups such as octenyl succinic acid anhydride.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydride-acrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably form 0.75% to 8%, most preferably from 1% to 6% by weight of the composition.

Preferred optical brighteners are anionic in character, examples of which are disodium 4,4'-bis-(2-diethanolamino-4-anilino-s-triazin-6-ylamino)stilbene-2:2'disulphonate, disodium 4,-4'-bis-(2-morpholino-4-anilino-s-triazin-6-ylamino-stilbene-2:2'-disulphonate, disodium 4,4'- bis-(2,4-dianilino-s-triazin-6-ylamino)stilbene-2:2'-disulphonate, monosodium 4',4"-bis-(2,4-dianilino-s-tri-azin-6 ylamino) stilbene-2-sulphonate, disodium 4,4'-bis-(2-anilino-4-(N-methyl-N-2-hydroxyethylamino)-s-triazin-6-ylamino) stilbene-2,2'-disulphonate, di-sodium 4,4'-bis-(4-phenyl-2,1,3-triazol-2-yl)-stilbene-2,2'disulphonate, di-so-dium 4,4'bis(2-anilino-4-(1-methyl-2-hydroxyethylamino)-s-triazin-6-ylamino)stilbene-2,"disulphonate, sodium 2(stilbyl-4"-(naphtho-1',2':4,5)-1,2,3,-triazole-2"-sulphonate and 4,4'-bis(2-sulphostyryl)biphenyl.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in U.S. Pat. Nos. 4,116,885 and 4,711,730 and EP 0 272 033. A particular preferred polymer in accordance with EP 0 272 033 has the formula:

$$(CH_3(PEG)_{43})_{0.75}(POH)_{0.25}[T\text{-}PO)_{2.8}(T\text{-}PEG)_{0.4}]$$
$$T(POH)_{0.25}((PEG)_{43}CH_3)_{0.75}$$

where PEG is —$(OC_2H_4)0$—, PO is $(OC_3H_6O)$ and T is $(pOOC_6H_4CO)$.

Also very useful are modified polyesters as random copolymers of dimethyl terephthalate, dimethyl sulfoisophthalate, ethylene glycol and 1,2-propanediol, the end groups consisting primarily of sulphobenzoate and secondarily of mono esters of ethylene glycol and/or 1,2-propanediol. The target is to obtain a polymer capped at both end by sulphobenzoate groups, "primarily", in the present context most of said copolymers herein will be endcapped by sulphobenzoate groups. However, some copolymers will be less than fully capped, and therefore their end groups may consist of monoester of ethylene glycol and/or 1,2-propanediol, thereof consist "secondarily" of such species.

The selected polyesters herein contain about 46% by weight of dimethyl terephthalic acid, about 16% by weight of 1,2-propanediol, about 10% by weight ethylene glycol, about 13% by weight of dimethyl sulfobenzoic acid and about 15% by weight of sulfoisophthalic acid, and have a molecular weight of about 3.000. The polyesters and their method of preparation are described in detail in EP 311 342.

Softening agents: Fabric softening agents can also be incorporated into laundry detergent compositions in accordance with the present invention. These agents may be inorganic or organic in type. Inorganic softening agents are exemplified by the smectite clays disclosed in GB-A-1 400898 and in U.S. Pat. No. 5,019,292. Organic fabric softening agents include the water insoluble tertiary amines as disclosed in GB-A1 514 276 and EP 0 011 340 and their combination with mono $C_{12}$–$C_{14}$ quaternary ammonium salts are disclosed in EP-B-0 026 528 and di-long-chain amides as disclosed in EP 0 242 919. Other useful organic ingredients of fabric softening systems include high molecular weight polyethylene oxide materials as disclosed in EP 0 299 575 and 0 313 146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight whilst the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Polymeric dye-transfer inhibiting agents: The detergent compositions according to the present invention may also comprise from 0.001% to 10%, preferably from 0.01% to 2%, more preferably form 0.05% to 1% by weight of polymeric dye- transfer inhibiting agents. Said polymeric dye-transfer inhibiting agents are normally incorporated into detergent compositions in order to inhibit the transfer of dyes from colored fabrics onto fabrics washed therewith. These polymers have the ability of complexing or adsorbing the fugitive dyes washed out of dyed fabrics before the dyes have the opportunity to become attached to other articles in the wash.

Especially suitable polymeric dye-transfer inhibiting agents are polyamine N-oxide polymers, copolymers of N-vinyl-pyrrolidone and N-vinylimidazole, polyvinylpyrrolidone polymers, polyvinyloxazolidones and polyvinylimidazoles or mixtures thereof.

Addition of such polymers also enhances the performance of the enzymes according the invention.

The detergent composition according to the invention can be in liquid, paste, gels, bars or granular forms.

Non-dusting granulates may be produced, e.g., as disclosed in U.S. Pat. Nos. 4,106,991 and 4,661,452 (both to Novo Industri A/S) and may optionally be coated by methods known in the art. Examples of waxy coating materials are poly(ethylene oxide) products (polyethyleneglycol, PEG) with mean molecular weights of 1000 to 20000; ethoxylated nonylphenols having from 16 to 50 ethylene oxide units; ethoxylated fatty alcohols in which the alcohol contains from 12 to 20 carbon atoms and in which there are 15 to 80 ethylene oxide units; fatty alcohols; fatty acids; and mono- and di- and triglycerides of fatty acids. Examples of film-forming coating materials suitable for application by fluid bed techniques are given in GB 1483591.

Granular compositions according to the present invention can also be in "compact form", i.e. they may have a relatively higher density than conventional granular detergents, i.e. form 550 to 950 g/l; in such case, the granular detergent compositions according to the present invention will contain a lower amount of "Inorganic filler salt", compared to conventional granular detergents; typical filler salts are alkaline earth metal salts of sulphates and chlorides, typically sodium sulphate; "Compact" detergent typically comprise not more than 10% filler salt. The liquid compositions according to the present invention can also be in "concentrated form", in such case, the liquid detergent compositions according to the present invention will contain a lower amount of water, compared to conventional liquid detergents. Typically, the water content of the concentrated liquid detergent is less than 30%, more preferably less than 20%, most preferably less than 10% by weight of the detergent compositions.

The compositions of the invention may for example, be formulated as hand and machine laundry detergent compositions including laundry additive compositions and compositions suitable for use in the pretreatment of stained fabrics, rinse added fabric softener compositions, and compositions for use in general household hard surface cleaning operations and dishwashing operations.

The following examples are meant to exemplify compositions for the present invention, but are not necessarily meant to limit or otherwise define the scope of the invention.

In the detergent compositions, the abbreviated component identifications have the following meanings:

| | |
|---|---|
| LAS: | Sodium linear $C_{12}$ alkyl benzene sulphonate |
| TAS: | Sodium tallow alkyl sulphate |
| XYAS: | Sodium $C_{1X}$–$C_{1Y}$ alkyl sulfate |
| SS: | Secondary soap surfactant of formula 2-butyl octanoic acid |
| 25EY: | A $C_{12}$–$C_{15}$ predominantly linear primary alcohol condensed with an average of Y moles of ethylene oxide |
| 45EY: | A $C_{14}$–$C_{15}$ predominantly linear primary alcohol condensed with an average of Y moles of ethylene oxide |
| XYEZS: | $C_{1X}$–$C_{1Y}$ sodium alkyl sulfate condensed with an average of Z moles of ethylene oxide per mole |
| Nonionic: | $C_{13}$–$C_{15}$ mixed ethoxylated/propoxylated fatty alcohol with an average degree of ethoxylation of 3.8 and an average degree of propoxylation of 4.5 sold under the tradename Plurafax LF404 by BASF Gmbh |
| CFAA: | $C_{12}$–$C_{14}$ alkyl N-methyl glucamide |
| TFAA: | $C_{16}$–$C_{18}$ alkyl N-methyl glucamide |
| Silicate: | Amorphous Sodium Silicate ($SiO_2$:$Na_2O$ ratio = 2.0) |
| NaSKS-6: | Crystalline layered silicate of formula $\delta$-$Na_2Si_2O_5$ |
| Carbonate: | Anhydrous sodium carbonate |
| Phosphate: | Sodium tripolyphosphate |
| MA/AA: | Copolymer of 1:4 maleic/acrylic acid, average molecular weight about 80,000 |
| Poly-acrylate: | Polyacrylate homopolymer with an average molecular weight of 8,000 sold under the tradename PA30 by BASF Gmbh |
| Zeolite A: | Hydrated Sodium Aluminosilicate of formula $Na_{12}(AlO_2SiO_2)_{12}$. $27H_2O$ having a primary particle size in the range from 1 to 10 micrometers |
| Citrate: | Tri-sodium citrate dihydrate |
| Citric: | Citric Acid |
| Perborate: | Anhydrous sodium perborate monohydrate bleach, empirical formula $NaBO_2.H_2O_2$ |
| PB4: | Anhydrous sodium perborate tetrahydrate |
| Per-carbonate: | Anhydrous sodium percarbonate bleach of empirical formula $2Na_2CO_3.3H_2O_2$ |
| TAED: | Tetraacetyl ethylene diamine |
| CMC: | Sodium carboxymethyl cellulose |
| DETPMP: | Diethylene triamine penta (methylene phosphonic acid), marketed by Monsanto under the Tradename Dequest 2060 |
| PVP: | Polyvinylpyrrolidone polymer |
| EDDS: | Ethylenediamine-N, N'-disuccinic acid, [S,S] isomer in the form of the sodium salt |
| Suds: | 25% paraffin wax Mpt 50° C., 17% hydrophobic silica, 58% |
| Suppressor: | paraffin oil |
| Granular Suds: | 12% Silicone/silica, 18% stearyl alcohol, 70% |
| suppressor: | Starch in granular form |
| Sulphate: | Anhydrous sodium sulphate |
| HMWPEO: | High molecular weight polyethylene oxide |
| TAE 25: | Tallow alcohol ethoxylate (25) |

Detergent Example I

A granular fabric cleaning composition in accordance with the invention may be prepared as follows:

| | |
|---|---|
| Sodium linear $C_{12}$ alkyl benzene sulfonate | 6.5 |
| Sodium sulfate | 15.0 |
| Zeolite A | 26.0 |
| Sodium nitrilotriacetate | 5.0 |
| Enzyme of the invention | 0.1 |
| PVP | 0.5 |
| TAED | 3.0 |
| Boric acid | 4.0 |
| Perborate | 18.0 |
| Phenol sulphonate | 0.1 |
| Minors | Up to 100 |

Detergent Example II

A compact granular fabric cleaning composition (density 800 g/l) in accord with the invention may be prepared as follows:

| | |
|---|---|
| 45AS | 8.0 |
| 25E3S | 2.0 |
| 25E5 | 3.0 |
| 25E3 | 3.0 |
| TFAA | 2.5 |
| Zeolite A | 17.0 |
| NaSKS-6 | 12.0 |
| Citric acid | 3.0 |
| Carbonate | 7.0 |
| MA/AA | 5.0 |
| CMC | 0.4 |
| Enzyme of the invention | 0.1 |
| TAED | 6.0 |
| Percarbonate | 22.0 |
| EDDS | 0.3 |
| Granular suds suppressor | 3.5 |
| water/minors | Up to 100% |

Detergent Example III

Granular fabric cleaning compositions in accordance with the invention which are especially useful in the laundering of coloured fabrics were prepared as follows:

| | | |
|---|---|---|
| LAS | 10.7 | — |
| TAS | 2.4 | — |
| TFAA | — | 4.0 |
| 45AS | 3.1 | 10.0 |
| 45E7 | 4.0 | — |
| 25E3S | — | 3.0 |
| 68E11 | 1.8 | — |
| 25E5 | — | 8.0 |
| Citrate | 15.0 | 7.0 |
| Carbonate | — | 10 |
| Citric acid | 2.5 | 3.0 |
| Zeolite A | 32.1 | 25.0 |
| Na-SKS-6 | — | 9.0 |
| MA/AA | 5.0 | 5.0 |
| DETPMP | 0.2 | 0.8 |
| Enzyme of the invention | 0.10 | 0.05 |
| Silicate | 2.5 | — |
| Sulphate | 5.2 | 3.0 |
| PVP | 0.5 | — |
| Poly (4-vinylpyridine)-N-Oxide/copolymer of vinyl-imidazole and vinyl-pyrrolidone | — | 0.2 |
| Perborate | 1.0 | — |
| Phenol sulfonate | 0.2 | — |
| Water/Minors | Up to 100% | |

Detergent Example IV

Granular fabric cleaning compositions in accordance with the invention which provide "Softening through the wash" capability may be prepared as follows:

| | | |
|---|---|---|
| 45AS | — | 10.0 |
| LAS | 7.6 | — |
| 68AS | 1.3 | — |
| 45E7 | 4.0 | — |
| 25E3 | — | 5.0 |
| Coco-alkyl-dimethyl hydroxy-ethyl ammonium chloride | 1.4 | 1.0 |
| Citrate | 5.0 | 3.0 |
| Na-SKS-6 | — | 11.0 |
| Zeolite A | 15.0 | 15.0 |
| MA/AA | 4.0 | 4.0 |
| DETPMP | 0.4 | 0.4 |
| Perborate | 15.0 | — |
| Percarbonate | — | 15.0 |
| TAED | 5.0 | 5.0 |
| Smectite clay | 10.0 | 10.0 |
| HMWPEO | — | 0.1 |
| Enzyme of the invention | 0.10 | 0.05 |
| Silicate | 3.0 | 5.0 |
| Carbonate | 10.0 | 10.0 |
| Granular suds suppressor | 1.0 | 4.0 |
| CMC | 0.2 | 0.1 |
| Water/Minors | Up to 100% | |

Detergent Example V

Heavy duty liquid fabric cleaning compositions in accordance with the invention may be prepared as follows:

| | I | II |
|---|---|---|
| LAS acid form | — | 25.0 |
| Citric acid | 5.0 | 2.0 |
| 25AS acid form | 8.0 | — |
| 25AE2S acid form | 3.0 | — |
| 25AE7 | 8.0 | — |
| CFAA | 5 | — |
| DETPMP | 1.0 | 1.0 |
| Fatty acid | 8 | — |
| Oleic acid | — | 1.0 |
| Ethanol | 4.0 | 6.0 |
| Propanediol | 2.0 | 6.0 |
| Enzyme of the invention | 0.10 | 0.05 |
| Coco-alkyl dimethyl hydroxy ethyl ammonium chloride | — | 3.0 |
| Smectite clay | — | 5.0 |
| PVP | 2.0 | — |
| Water / Minors | Up to 100% | |

Improvements in pilling resistance may be determined using the Martindale pilling tester (Swiss standard SN 198525).

In Example 2, below, a method of determining the reduction of the pilling propensity of polyester fabrics and garments is described.

Additional Benefits from the Method of the Invention

The present invention is directed to the use of a ETE hydrolytic enzyme and/or a BEB hydrolytic enzyme for reducing the pilling propensity, and find use in a the method of reducing the pilling propensity of polyester fabrics or garments.

However, from experiments with use of a ETE hydrolytic enzyme and/or a BEB hydrolytic enzyme for reducing the pilling propensity, it has also been found that the method of the present invention allow for improvements in colour clarification. Therefore, in a preferred embodiment, the method of the invention may be carried out simultaneously with conventional colour clarification processes. Colour clarification processes have been described in e.g. EP 220, 016; WO 91/17243; WO 89/09259; WO 91/19807; WO 94/07998 and WO 96/29397. In particular, the method of the invention may be carried out simultaneously with a laundry process and in the presence of a cellulytic enzyme.

The term "colour clarification", as used herein, refers to preservation of the initial colours throughout multiple washing cycles by removing fuzz and pills from the surface of garment and/or fabric. The colour clarification ability may be determined by measuring the reflectance of the textile. These data are used to calculate the colour difference by use of the Hunter equation, as described in Example 3, below.

Also the method of the invention allow for improved soil release properties, in particular of oily stains, probably due to increased hydrophilicity of the polyester fibers.

Finally, the method of the invention was found to improve the antistatic properties of polyester fabrics and/or garments.

EXAMPLES

The invention is further illustrated with reference to the following examples which are not intended to be in any way limiting to the scope of the invention as claimed.

EXAMPLE 1

Hydrolytic Activity

This example described an assay for determining the terephtalic acid diethyl ester (ETE) and/or an ethyleneglycol dibenzyl ester (BEB) hydrolytic activity of an enzyme.

ETE Hydrolytic Activity

An ETE hydrolytic enzyme of the invention is an enzyme capable of hydrolyzing terephtalic acid diethyl ester (ETE), as determined by the following assay.

In a test tube, 0.250 ml of 0.20M glycylglycine pH 8.5, and 0.250 ml of 10.0 mM terephthalic acid diethyl ester (ETE) in 1,4-dioxane, is added to 2.000 ml of de-ionized water.

The mixture is pre-incubated under stirring at 30° C. for approximately 15 minutes, followed by the addition of 25.0 μg of enzyme in the lowest possible volume.

This mixture is then subjected to incubation under stirring at 30° C. for 16 hours.

The reaction mixture is analyzed on a reverse phase HPLC, ODS (octa dodecyl silicate) column, and eluted with increasing concentration of acetonitrile and decreasing concentration of 200 mM $NaPO_4$, pH 3.0.

Detection of the reaction products is carried out spectrophotometrically at 240 nm, at which wavelength terephtalic acid and terephtalate derivatives adsorb.

BEB Hydrolytic Activity

An BEB hydrolytic enzyme of the invention is an enzyme capable of hydrolyzing ethyleneglycol dibenzyl ester (BEB). Dependent on the amount of dioxane present in the assay (BEB is only partially dissolved in a 10% dioxane solution, but fully dissolved in a 30% dioxane solution), the BEB hydrolytic enzyme of the invention may be a $BEB^{10}$ hydrolytic enzyme or a $BEB^{30}$ hydrolytic enzyme, as determined by the following assays.

$BEB^{10}$ Hydrolytic Activity

In a test tube, 0.250 ml of 0.20M glycylglycine pH 8.5, and 0.250 ml of 10.0 mM ethyleneglycol dibenzyl ester (BEB) in 1,4-dioxane, is added to 2.000 ml of de-ionized water.

The mixture is pre-incubated under stirring at 30° C. for approximately 15 minutes, followed by the addition of 25.0 μg of enzyme in the lowest possible volume.

This mixture is then subjected to incubation under stirring at 30° C. for 16 hours.

The reaction mixture is analyzed on a reverse phase HPLC, ODS (octa dodecyl silicate) column, and eluted with increasing concentration of acetonitrile and decreasing concentration of 200 mM $NaPO_4$, pH 3.0.

Detection of the reaction products is carried out spectrophotometrically at 240 nm, at which wavelength terephtalic acid and terephtalate derivatives adsorb.

$BEB^{30}$ Hydrolytic Activity

In a test tube, 0.250 ml of 0.20M glycylglycine pH 8.5, 0.250 ml of 10.0 mM ethyleneglycol dibenzyl ester (BEB) in 1,4-dioxane, and 0.500 ml of 1,4-dioxane, is added to 1.500 ml of de-ionized water.

The mixture is pre-incubated under stirring at 30° C. for approximately 15 minutes, followed by the addition of 25.0 μg of enzyme in the lowest possible volume.

This mixture is then subjected to incubation under stirring at 30° C. for 16 hours.

The reaction mixture is analyzed on a reverse phase HPLC, ODS (octa dodecyl silicate) column, and eluted with increasing concentration of acetonitrile and decreasing concentration of 200 mM $NaPO_4$, pH 3.0.

Detection of the reaction products is carried out spectrophotometrically at 240 nm, at which wavelength terephtalic acid and terephtalate derivatives adsorb.

Microbial Sources

A number of enzymes from different microbial sources were subjected to the assay for determining BEB and ETE hydrolytic activity, and the results obtained are presented in Table 1, below:

TABLE 1

Enzymes having BEB and/or ETE Hydrolytic Activity; % Degradation of Substrate

| Enzyme | Substrate | | |
|---|---|---|---|
| Microbial Source | $BEB^{30}$ | $BEB^{10}$ | ETE |
| *Humicola insolens*[1)] | 100 | 100 | 95 |
| *Candida antarctica*[2)] | 60 | 100 | 100 |
| *Pseudomonas cepacia*[3)] | 95 | — | 60 |
| *Candida cylindracea*[4)] | 0 | 100 | 15 |
| GA[5)] | 0 | 0 | 5 |

1) *Humicola insolens* cutinase (actually a lipase also having cutinase activity) obtained from the strain DSM 1800 as described in Example 2 of U.S. Pat. No. 4,810,414.

2) *Candida antarctica* Component B obtained as described in Example 10 of WO 88/02775. Briefly, the enzyme was recovered from the culture broth of *Candida antarctica* by 1) drum filtration, 2) clear filtration, 3) concentration by ultrafiltration, 4) addition of ethanol to 50% w/w, 5) clear filtration, 6) concentration by ultrafiltration, 7) addition of ethanol to 77% w/w, 8) centrifugation, 9) vacuum drying, 10) redissolving in water, 11) batch hydrophobic interaction purification, 12) evaporation and freeze drying, 13) suspension of the powder in 50 mM Tris-acetate pH 6, 14) addition of DEAE-Sephadex A50, 15) filtration, 16) concentration by ultrafiltration, 17) chromatography on CM-Sepharose in 20 mM citrate buffer pH 4.5, 18) recovery of flow-through, and 19) chromatography on Mono-Q (Pharmacia), including elution with a salt gradient.

3) *Pseudomonas cepacia* obtained as described in EP 331,376 from *P. cepacia* strain M-12-33, deposited in Fermentation Research Institute, Ageny of Industrial Science and Technology under deposit number FERM BP-2293.

4) *Candida cylindracea* (syn. *Candida rugosa*) lipase obtained from Nippon Oil & Fats Co. Ltd., Japan).

5) Glucosaminated Lipolase™ obtained as described in Example 7A of WO 95/09909. Briefly, glucosamine was added to a concentration of 3 mg/ml in a 3 mg/ml solution of Lipolase (Novo Nordisk) in 50 mM MES pH 5.0 containing 200 mM NaCl., after which 5 mg EDC was added and the mixture was incubated at room temperature for 2 hours. The mixture was dialyzed extensively against 0.2M ammonium acetate pH 6.9 at 5° C.

EXAMPLE 2

Reduced Pilling Propensities

This example describes an assay for determining the reduction of pilling propensity of polyester fabrics and garments.

200 ml Britton-Robinson buffer pH 7.5 added 0.2 g/l Lutensol TO5 (BASF) is added to each Launder-O-meter beaker including 5 steel balls. The beakers are equilibrated at 50° C. Two knitted polyester/cotton (50/50%) swatches (approx. 14×14 cm each) are added to each Launder-O-meter beaker. Enzyme (Humicola insolens cutinase) is added at different dosages (0.01%–0.2% on weight of fabric) including a blank without enzyme. The swatches are incubated 2 hours at 50° C. in the Launder-O-meter. After incubation the swatches are given a short rinse in a household laundry machine and tumble dried.

The cycle of incubation and rinsing/drying is repeated once or until the swatches differs in respect to pilling propensity.

Improvement in pilling resistance is measured using the Martindale pilling tester (Swiss standard SN 198525). An improvement is considered significant if the pilling grade is improved more than half a grade.

EXAMPLE 3

Colour Clarification

This example describes an assay for determining the colour clarification ability on polyester fabrics.

A dyed polyester/cotton fabric that has been pre-washed e.g. 10 times in a household laundry machine in order to obtain a matted and pilled appearance of the fabric surface is used as a test swatch.

150 ml Britton-Robinson buffer pH 7.5 added 0.2 g/l Lutensol TO5 (BASF) is added to each Launder-O-meter beaker including 5 steel balls. The beakers are equilibrated at 50° C. Two knitted pre-washed polyester/cotton (50/50%) swatches (approx. 10×10 cm each) are added to each Launder-O-meter beaker. Enzyme (Humicola insolens cutinase) is added at different dosages (0.01%–0.2% on weight of fabric) including a blank without enzyme. The swatches are incubated 2 hours at 50° C. in the Launder-O-meter. After incubation the swatches are given a short rinse in a household laundry machine and tumble dried. The cycle of incubation and rinsing/drying is repeated once or until the swatches clearly differed in respect to color (fuzz) on the swatches.

Finally, the swatches are graded visually against the blank (no enzyme) and the colour difference are measured using a reflectance spectrophotometer. The colour clarification ability of the enzyme can be detected by measuring the colour difference between the enzyme treated swatch and the blank. The Hunter L co-ordinate, among others (e.g. CIE Lab L*) may be used for this purpose (AATCC Test Method 153-1985 "Color Measurements of Textiles: Instrumental")

I claim:

1. A method of reducing the pilling propensity of a polyester fabric, which comprises treating the fabric or garment with an enzyme selected from the group consisting of a terephtalic acid diethyl ester hydrolytic enzyme (ETE hydrolytic enzyme), an ethyleneglycol dibenzyl ester hydrolytic enzyme (BEB hydrolytic enzyme), and combinations of the foregoing, wherein said method is carried out in presence of a detergent.

2. The method according to claim 1, wherein the fabric or garment is treated with a terephtalic acid diethyl ester hydrolytic enzyme (ETE hydrolytic enzyme).

3. The method according to claim 1, wherein the fabric or garment is treated with an ethyleneglycol dibenzyl ester hydrolytic enzyme (BEB hydrolytic enzyme).

4. The method according to claim 1, further comprising treating said fabric or garment with an enzyme selected from the group consisting of proteases, amylases, cellulases, peroxidases, oxidases, pectinases, lipases other than ETE or BEB hydrolyases, and combinations of any of the foregoing.

5. The method according to claim 4, wherein said fabric or garment is treated with a cellulytic enzyme.

6. A method of colour clarification of a polyester fabric or garment, which comprises treating the fabric or garment with with an enzyme selected from the group consisting of a terephtalic acid diethyl ester hydrolytic enzyme (ETE hydrolytic enzyme), an ethyleneglycol dibenzyl ester hydrolytic enzyme (BEB hydrolytic enzyme), and combinations of the foregoing, wherein said method is carried out in presence of a detergent.

7. The method according to claim 6, wherein the fabric or garment is treated with a terephtalic acid diethyl ester hydrolytic enzyme (ETE hydrolytic enzyme).

8. The method according to claim 4, wherein the fabric or garment is treated with an ethyleneglycol dibenzyl ester hydrolytic enzyme (BEB hydrolytic enzyme).

9. The method according to claim 6, further comprising treating said fabric or garment with an enzyme selected from the group consisting of proteases, amylases, cellulases, peroxidases, oxidases, and pectinases lipases other than ETE or BEB hydrolyases, and combinations of any of the foregoing.

10. The method according to claim 9, wherein said fabric or garment is treated with a cellulytic enzyme.

* * * * *

UNITED STATES PATENT AND TRADEMARK OFFICE
CERTIFICATE OF CORRECTION

| | | |
|---|---|---|
| PATENT NO. | : | 5,997,584 |
| DATED | : | December 7, 1999 |
| INVENTOR(S) | : | Andersen et al. |

It is certified that error appears in the above-identified patent and that said Letters Patent is hereby corrected as shown below:

Col. 24, claim 8, line 41, delete "4" and insert --6--

Signed and Sealed this

Fourteenth Day of November, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,997,584
APPLICATION NO. : 09/116015
DATED : December 7, 1999
INVENTOR(S) : Andersen et al.

It is certified that error appears in the above-identified patent and that said Letters Patent is hereby corrected as shown below:

On the title page, "Related U.S. Application Data", insert:

item --(63) Continuation of PCT/DK98/00306 filed Jul. 3 1998--

Signed and Sealed this
Seventeenth Day of January, 2012

David J. Kappos

David J. Kappos
*Director of the United States Patent and Trademark Office*